US010674259B2

(12) United States Patent
Lovitt et al.

(10) Patent No.: US 10,674,259 B2
(45) Date of Patent: Jun. 2, 2020

(54) VIRTUAL MICROPHONE

(71) Applicant: Facebook Technologies, LLC, Menlo Park, CA (US)

(72) Inventors: Andrew Lovitt, Redmond, WA (US); Antonio John Miller, Woodinville, WA (US); Philip Robinson, Seattle, WA (US); Scott Selfon, Kirkland, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/171,878

(22) Filed: Oct. 26, 2018

(65) Prior Publication Data

US 2020/0137488 A1 Apr. 30, 2020

(51) Int. Cl.

| | |
|---|---|
| ***H04R 5/00*** | (2006.01) |
| ***H04R 3/00*** | (2006.01) |
| ***H04R 5/04*** | (2006.01) |
| ***H04R 5/027*** | (2006.01) |
| ***H04R 5/02*** | (2006.01) |
| ***H04R 3/12*** | (2006.01) |

(52) U.S. Cl.

CPC ..... *H04R 3/005* (2013.01); *H04R 3/12* (2013.01); *H04R 5/02* (2013.01); *H04R 5/027* (2013.01); *H04R 5/04* (2013.01); *H04R 2499/11* (2013.01)

(58) Field of Classification Search

CPC ..... H04R 5/00

See application file for complete search history.

(56) References Cited

U.S. PATENT DOCUMENTS

| | | | | |
|---|---|---|---|---|
| 9,704,533 | B2 * | 7/2017 | Warner | G11B 27/034 |
| 9,912,909 | B2 * | 3/2018 | Chen | H04N 7/147 |
| 10,110,994 | B1 * | 10/2018 | Davis | H04R 1/406 |
| 10,306,362 | B1 * | 5/2019 | Russo | H04R 3/005 |
| 2008/0091425 | A1 * | 4/2008 | Kane | G10L 17/04 704/246 |
| 2012/0084087 | A1 * | 4/2012 | Yang | G10L 17/00 704/246 |
| 2012/0095764 | A1 * | 4/2012 | Jeon | G10L 15/1822 704/246 |
| 2012/0323575 | A1 * | 12/2012 | Gibbon | G11B 27/34 704/246 |
| 2015/0237455 | A1 * | 8/2015 | Mitra | H04N 7/183 381/92 |
| 2015/0264505 | A1 * | 9/2015 | Tsilfidis | H04S 3/00 381/303 |

(Continued)

*Primary Examiner* — Olisa Anwah

(74) *Attorney, Agent, or Firm* — FisherBroyles, LLP

(57) ABSTRACT

The disclosed computer-implemented method may include establishing and implementing a virtual microphone. The method may include receiving an input specifying a location for a virtual microphone that is configured to capture audio as if located in the specified location. The method may next include initializing physical microphones to begin capturing audio as if located at the specified location. The physical microphones may be electronically or physically oriented to listen from the specified location. The method may then include combining audio streams from the physical microphones to generate a combined audio signal that sounds as if recorded at the specified location. Various other methods, systems, and computer-readable media are also disclosed.

20 Claims, 9 Drawing Sheets

(56) References Cited

U.S. PATENT DOCUMENTS

| | | | | |
|---|---|---|---|---|
| 2016/0042767 | A1* | 2/2016 | Araya | G11B 19/02 386/201 |
| 2017/0076749 | A1* | 3/2017 | Kanevsky | G10L 17/00 |
| 2018/0115744 | A1* | 4/2018 | Bayley | H04N 7/06 |
| 2018/0191908 | A1* | 7/2018 | Mehta | H04N 7/152 |

* cited by examiner

VIRTUAL MICROPHONE

BACKGROUND

Mobile electronic devices are ubiquitous in today's world. Users can use these mobile electronic devices to perform a wide variety of functions. For instance, smart phones allow users to make phone or video calls over cellular or WiFi networks. Smart phones include microphones that detect the user's voice (and other surrounding audio) and convert the user's voice into an audio signal. This audio signal may then be transmitted to a receiving user's phone. Microphones on such devices may be used for phone calls but may also be used for other applications including dictation or language translation. Even in these applications, however, the microphone merely detects sounds coming from a sound source and provides the resulting audio signal to a processor for further processing.

SUMMARY

As will be described in greater detail below, the instant disclosure describes methods and systems that may establish a virtual microphone at a specified location. The virtual microphone may use multiple physical microphones at potentially different locations to record an audio signal as if it were recorded from the specified location.

In one example, a computer-implemented method for establishing and implementing a virtual microphone may include receiving an input specifying a location for a virtual microphone that is configured to capture audio as if located in the specified location. The method may next include initializing physical microphones to begin capturing audio as if located at the specified location. The physical microphones may be electronically or physically oriented to listen from that location. The method may then include combining audio streams from the physical microphones to generate a combined audio signal that sounds as if recorded at the specified location.

In some examples, the method may further include receiving information relative to an environment, determining that the specified location is within the environment, and implementing the received environment information to customize acoustic characteristics of the specified location. In some examples, the environment information indicates that the specified location is within a building, and may further indicate which part of the building the specified location is in. In some examples, the environment information indicates that people are within a given distance of the specified location, or that a specific person is within a given distance of the specified location.

In some examples, other mobile devices having microphones that come within a specified distance of the specified location may be initialized to capture audio and provide the captured audio to the combined audio stream. In some examples, the method for establishing and implementing a virtual microphone may further include analyzing the combined audio streams from the physical microphones to identify the presence of people or specific persons that are within audible range of the specified location. In some examples, the virtual microphone may be governed by policies indicating when capturing audio from the virtual microphone is permissible and when not permissible. In some examples, the virtual microphone policies may be geography-based, time-based or individual-based.

In some examples, the virtual microphone may be activated automatically upon detecting audible sounds within range of the virtual microphone. In some examples, the method may further include taking observations about the specified location. These observations may be stored in a local or distributed data store. In some examples, the two or more physical microphones are at least initially not located at the specified location.

In some examples, at least one of the physical microphones may be embedded in a mobile device associated with a user. The user may opt in to allow their mobile device to be used as a virtual microphone. In some examples, the user's opt in may be subject to policies indicating times and locations where their mobile device is usable as a virtual microphone. In some examples, a user-initiated placement of the virtual microphone may be overridden by a location-based policy indicating that virtual microphones are disallowed at the specified location. In such examples, the initialized physical microphones may be disengaged.

In some examples, the method may further include initializing physical speakers at a specified location. The physical speakers may be electronically or physically oriented to project sound as if coming from the specified location. In some examples, the method may further include associating a sequence of actions with the specified location, so that when a user is detected in the specified location, the sequence of actions is carried out. In some examples, the sequence of actions may take place at a scheduled time.

In addition, a corresponding system for establishing and implementing a virtual microphone may include several modules stored in memory, including an input receiving module configured to receive an input specifying a location for a virtual microphone that is configured to capture audio as if located in the specified location. The system may also include a hardware initialization module configured to initialize physical microphones to begin capturing audio as if located at the specified location. The physical microphones may be electronically or physically oriented to listen from the specified location. The system may also include an audio stream processor configured to combine audio streams from the physical microphones to generate a combined audio signal that sounds as if recorded at the specified location.

In some examples, the above-described method may be encoded as computer-readable instructions on a computer-readable medium. For example, a computer-readable medium may include one or more computer-executable instructions that, when executed by at least one processor of a computing device, may cause the computing device to receive an input specifying a location for a virtual microphone that is configured to capture audio as if located in the specified location, and initialize physical microphones to begin capturing audio as if located at the specified location. The physical microphones may be electronically or physically oriented to listen from the specified location. The computing device may also combine audio streams from the physical microphones to generate a combined audio signal that sounds as if recorded at the specified location.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification.

Together with the following description, these drawings demonstrate and explain various principles of the instant disclosure.

Figure 1:
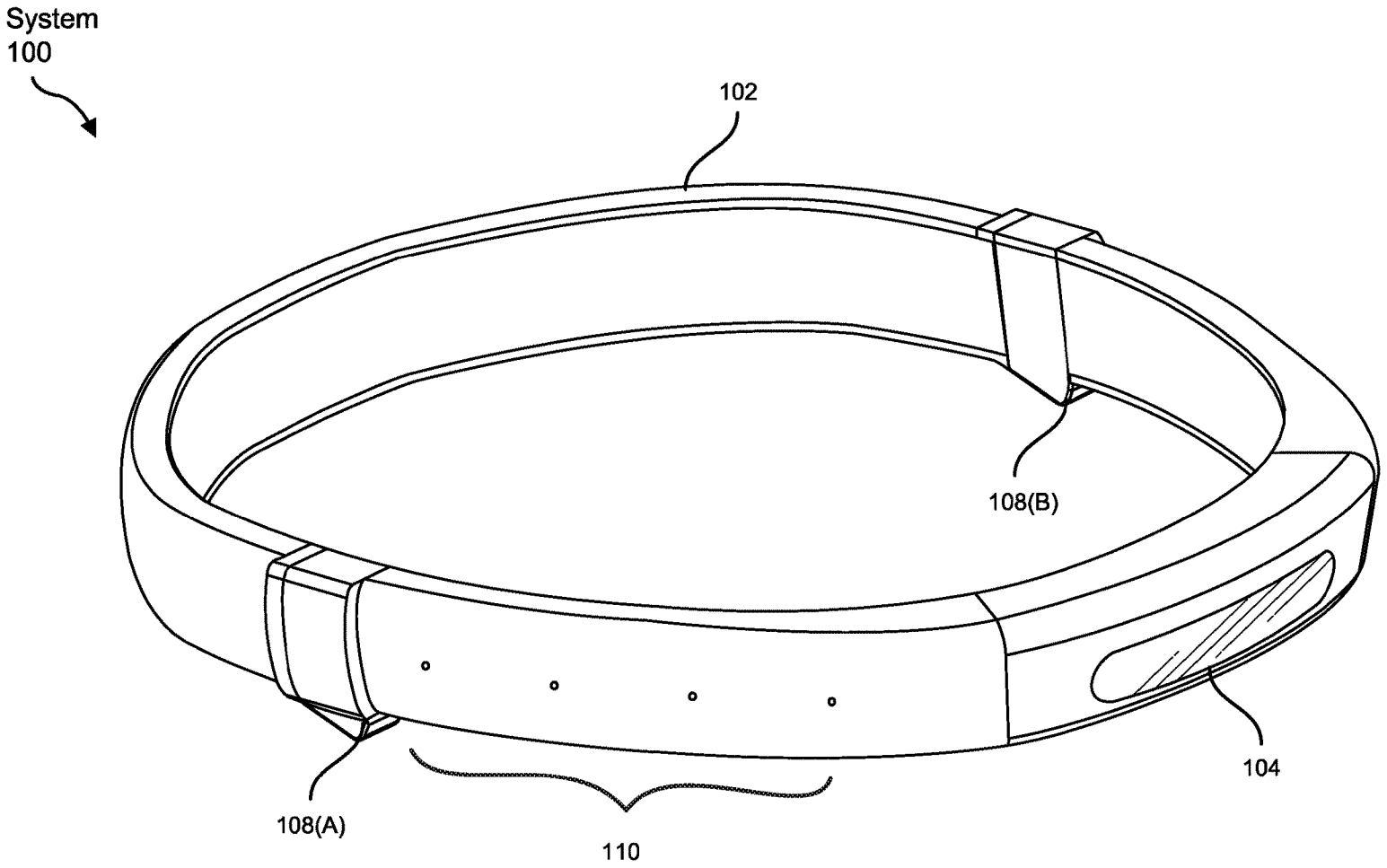
FIG. 1 illustrates an embodiment of an artificial reality headset.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The present disclosure is generally directed to systems and methods for initializing and operating a virtual microphone. As will be explained in greater detail below, embodiments of the instant disclosure may establish a virtual microphone at a specified location. The virtual microphone may use physical microphones from other electronic devices (e.g., phones or artificial reality devices) that are near the specified location. The electronic devices may be configured to direct the focus of their microphones to the specified location, and then capture audio as if the microphones were actually located at the specified location. The virtual microphone may use substantially any microphones from any devices that come within range of the specified location. In some cases, virtual microphone functionality may be regulated by policies and may be disallowed by default unless specifically opted into by a user.

In one embodiment, users may be wearing artificial headsets in an indoor or outdoor environment. These users may wish to record audio from a specified location without necessarily placing a physical microphone in that location. As such, a user may establish a virtual microphone by specifying a location and initializing at least two physical microphones configured to listen from that location. The audio feeds from the two microphones may then be combined into a single audio stream that sounds as if recorded at the specified location.

As users wander about the environment, their artificial reality headsets and/or phones may come into range of the specified location. If opted in, the microphone(s) in the users' artificial reality headsets, phones or other devices may be initialized and pointed at the specified location. As such, the microphones in the users' mobile devices may each record audio as if from the specified location, and provide those audio streams to a single device, or to a remote server (e.g., a cloud server) for processing. This processing may combine the audio feeds into a single feed that sounds as if recorded at the specified location. Once a user's mobile device is out of range of the specified location, the microphones on that user's device may be turned off, and that user's device will no longer be contributing to the virtual microphone.

Embodiments of the instant disclosure may include or be implemented in conjunction with various types of artificial reality systems. Artificial reality is a form of reality that has been adjusted in some manner before presentation to a user, which may include, e.g., a virtual reality (VR), an augmented reality (AR), a mixed reality (MR), a hybrid reality, or some combination and/or derivative thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., to perform activities in) an artificial reality.

Artificial reality systems may be implemented in a variety of different form factors and configurations. Some artificial reality systems may be designed to work without near-eye displays (NEDs), an example of which is AR system 100 in FIG. 1. Other artificial reality systems may include an NED that also provides visibility into the real world (e.g., AR system 200 in FIG. 2) or that visually immerses a user in an artificial reality (e.g., VR system 300 in FIG. 3). While some artificial reality devices may be self-contained systems, other artificial reality devices may communicate and/or coordinate with external devices to provide an artificial reality experience to a user. Examples of such external devices include handheld controllers, mobile devices, desktop computers, devices worn by a user, devices worn by one or more other users, and/or any other suitable external system.

Turning to FIG. 1, AR system 100 generally represents a wearable device dimensioned to fit about a body part (e.g., a head) of a user. As shown in FIG. 1, system 100 may include a frame 102 and a camera assembly 104 that is coupled to frame 102 and configured to gather information about a local environment by observing the local environment. AR system 100 may also include one or more audio devices, such as output audio transducers 108(A) and 108(B) and input audio transducers 110. Output audio transducers 108(A) and 108(B) may provide audio feedback and/or content to a user, and input audio transducers 110 may capture audio in a user's environment.

As shown, AR system 100 may not necessarily include an NED positioned in front of a user's eyes. AR systems without NEDs may take a variety of forms, such as head bands, hats, hair bands, belts, watches, wrist bands, ankle bands, rings, neckbands, necklaces, chest bands, eyewear frames, and/or any other suitable type or form of apparatus. While AR system 100 may not include an NED, AR system 100 may include other types of screens or visual feedback devices (e.g., a display screen integrated into a side of frame 102).

Figure 2:
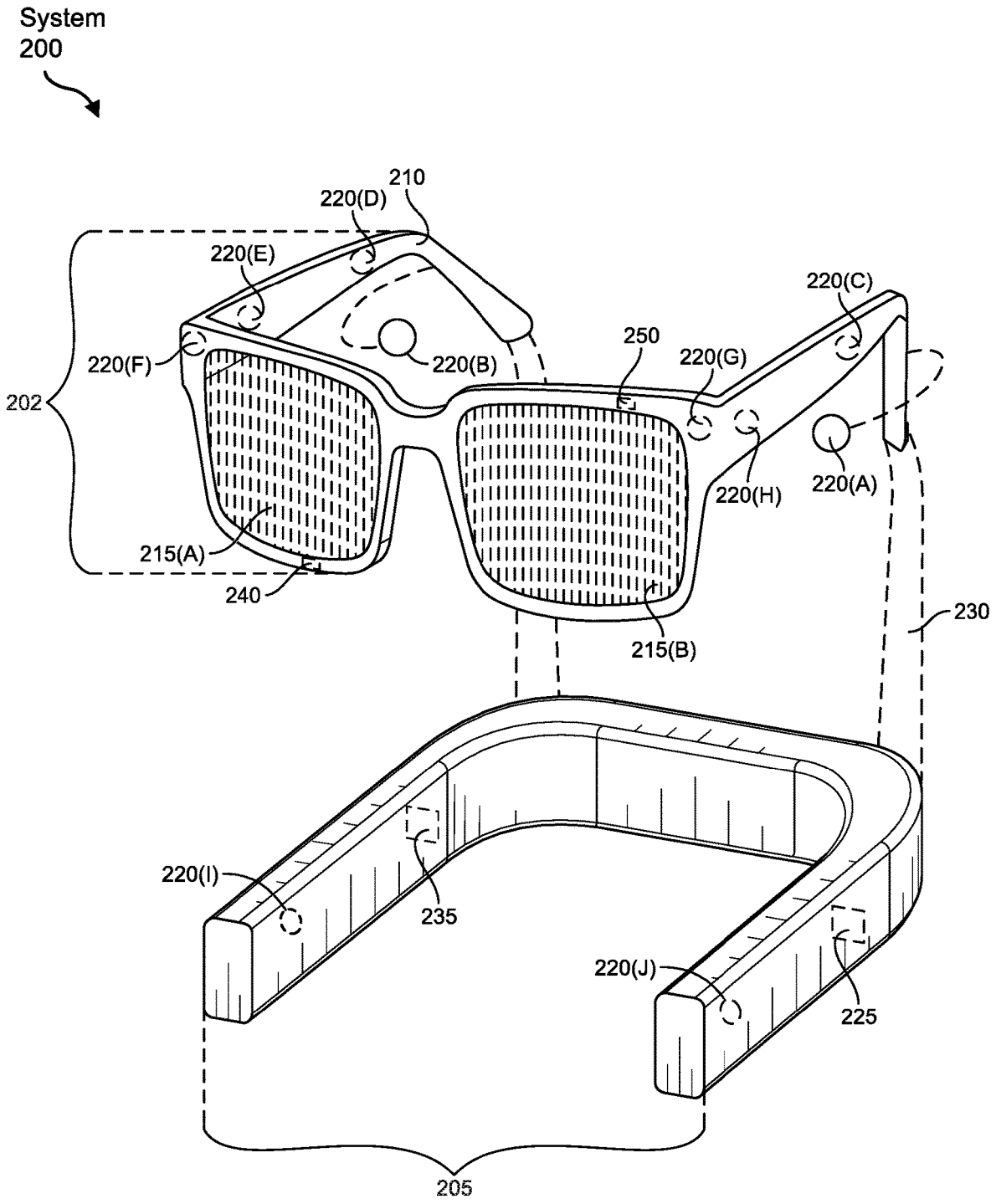
FIG. 2 illustrates an embodiment of an augmented reality headset and corresponding neckband.

The embodiments discussed in this disclosure may also be implemented in AR systems that include one or more NEDs. For example, as shown in FIG. 2, AR system 200 may include an eyewear device 202 with a frame 210 configured to hold a left display device 215(A) and a right display device 215(B) in front of a user's eyes. Display devices 215(A) and 215(B) may act together or independently to present an image or series of images to a user. While AR system 200 includes two displays, embodiments of this disclosure may be implemented in AR systems with a single NED or more than two NEDs.

In some embodiments, AR system 200 may include one or more sensors, such as sensor 240. Sensor 240 may generate measurement signals in response to motion of AR system 200 and may be located on substantially any portion of frame 210. Sensor 240 may include a position sensor, an inertial measurement unit (IMU), a depth camera assembly, or any combination thereof. In some embodiments, AR system 200 may or may not include sensor 240 or may include more than one sensor. In embodiments in which sensor 240 includes an IMU, the IMU may generate calibration data based on measurement signals from sensor 240. Examples of sensor 240 may include, without limitation, accelerometers, gyroscopes, magnetometers, other suitable types of sensors that detect motion, sensors used for error correction of the IMU, or some combination thereof.

AR system 200 may also include a microphone array with a plurality of acoustic sensors 220(A)-220(J), referred to collectively as acoustic sensors 220. Acoustic sensors 220 may be transducers that detect air pressure variations induced by sound waves. Each acoustic sensor 220 may be configured to detect sound and convert the detected sound into an electronic format (e.g., an analog or digital format). The microphone array in FIG. 2 may include, for example, ten acoustic sensors: 220(A) and 220(B), which may be designed to be placed inside a corresponding ear of the user, acoustic sensors 220(C), 220(D), 220(E), 220(F), 220(G), and 220(H), which may be positioned at various locations on frame 210, and/or acoustic sensors 220(I) and 220(J), which may be positioned on a corresponding neckband 205.

The configuration of acoustic sensors 220 of the microphone array may vary. While AR system 200 is shown in FIG. 2 as having ten acoustic sensors 220, the number of acoustic sensors 220 may be greater or less than ten. In some embodiments, using higher numbers of acoustic sensors 220 may increase the amount of audio information collected and/or the sensitivity and accuracy of the audio information. In contrast, using a lower number of acoustic sensors 220 may decrease the computing power required by the controller 250 to process the collected audio information. In addition, the position of each acoustic sensor 220 of the microphone array may vary. For example, the position of an acoustic sensor 220 may include a defined position on the user, a defined coordinate on the frame 210, an orientation associated with each acoustic sensor, or some combination thereof.

Acoustic sensors 220(A) and 220(B) may be positioned on different parts of the user's ear, such as behind the pinna or within the auricle or fossa. Or, there may be additional acoustic sensors on or surrounding the ear in addition to acoustic sensors 220 inside the ear canal. Having an acoustic sensor positioned next to an ear canal of a user may enable the microphone array to collect information on how sounds arrive at the ear canal. By positioning at least two of acoustic sensors 220 on either side of a user's head (e.g., as binaural microphones), AR device 200 may simulate binaural hearing and capture a 3D stereo sound field around about a user's head. In some embodiments, the acoustic sensors 220(A) and 220(B) may be connected to the AR system 200 via a wired connection, and in other embodiments, the acoustic sensors 220(A) and 220(B) may be connected to the AR system 200 via a wireless connection (e.g., a Bluetooth connection). In still other embodiments, the acoustic sensors 220(A) and 220(B) may not be used at all in conjunction with the AR system 200.

Acoustic sensors 220 on frame 210 may be positioned along the length of the temples, across the bridge, above or below display devices 215(A) and 215(B), or some combination thereof. Acoustic sensors 220 may be oriented such that the microphone array is able to detect sounds in a wide range of directions surrounding the user wearing the AR system 200. In some embodiments, an optimization process may be performed during manufacturing of AR system 200 to determine relative positioning of each acoustic sensor 220 in the microphone array.

AR system 200 may further include or be connected to an external device. (e.g., a paired device), such as neckband 205. As shown, neckband 205 may be coupled to eyewear device 202 via one or more connectors 230. The connectors 230 may be wired or wireless connectors and may include electrical and/or non-electrical (e.g., structural) components. In some cases, the eyewear device 202 and the neckband 205 may operate independently without any wired or wireless connection between them. While FIG. 2 illustrates the components of eyewear device 202 and neckband 205 in example locations on eyewear device 202 and neckband 205, the components may be located elsewhere and/or distributed differently on eyewear device 202 and/or neckband 205. In some embodiments, the components of the eyewear device 202 and neckband 205 may be located on one or more additional peripheral devices paired with eyewear device 202, neckband 205, or some combination thereof. Furthermore, neckband 205 generally represents any type or form of paired device. Thus, the following discussion of neckband 205 may also apply to various other paired devices, such as smart watches, smart phones, wrist bands, other wearable devices, hand-held controllers, tablet computers, laptop computers, etc.

Pairing external devices, such as neckband 205, with AR eyewear devices may enable the eyewear devices to achieve the form factor of a pair of glasses while still providing sufficient battery and computation power for expanded capabilities. Some or all of the battery power, computational resources, and/or additional features of AR system 200 may be provided by a paired device or shared between a paired device and an eyewear device, thus reducing the weight, heat profile, and form factor of the eyewear device overall while still retaining desired functionality. For example, neckband 205 may allow components that would otherwise be included on an eyewear device to be included in neckband 205 since users may tolerate a heavier weight load on their shoulders than they would tolerate on their heads. Neckband 205 may also have a larger surface area over which to diffuse and disperse heat to the ambient environment. Thus, neckband 205 may allow for greater battery and computation capacity than might otherwise have been possible on a stand-alone eyewear device. Since weight carried in neckband 205 may be less invasive to a user than weight carried in eyewear device 202, a user may tolerate wearing a lighter eyewear device and carrying or wearing the paired device for greater lengths of time than the user would tolerate wearing a heavy standalone eyewear device, thereby enabling an artificial reality environment to be incorporated more fully into a user's day-to-day activities.

Neckband 205 may be communicatively coupled with eyewear device 202 and/or to other devices. The other devices may provide certain functions (e.g., tracking, localizing, depth mapping, processing, storage, etc.) to the AR system 200. In the embodiment of FIG. 2, neckband 205 may include two acoustic sensors (e.g., 220(I) and 220(J)) that are part of the microphone array (or potentially form their own microphone subarray). Neckband 205 may also include a controller 225 and a power source 235.

Acoustic sensors 220(I) and 220(J) of neckband 205 may be configured to detect sound and convert the detected sound into an electronic format (analog or digital). In the embodiment of FIG. 2, acoustic sensors 220(I) and 220(J) may be positioned on neckband 205, thereby increasing the distance between the neckband acoustic sensors 220(I) and 220(J) and other acoustic sensors 220 positioned on eyewear device 202. In some cases, increasing the distance between acoustic sensors 220 of the microphone array may improve the accuracy of beamforming performed via the microphone array. For example, if a sound is detected by acoustic sensors 220(C) and 220(D) and the distance between acoustic sensors 220(C) and 220(D) is greater than, e.g., the distance between acoustic sensors 220(D) and 220(E), the determined source location of the detected sound may be more accurate than if the sound had been detected by acoustic sensors 220(D) and 220(E).

Controller 225 of neckband 205 may process information generated by the sensors on neckband 205 and/or AR system 200. For example, controller 225 may process information from the microphone array that describes sounds detected by the microphone array. For each detected sound, controller 225 may perform a DoA estimation to estimate a direction from which the detected sound arrived at the microphone array. As the microphone array detects sounds, controller 225 may populate an audio data set with the information. In embodiments in which AR system 200 includes an inertial measurement unit, controller 225 may compute all inertial and spatial calculations from the IMU located on eyewear device 202. Connector 230 may convey information between AR system 200 and neckband 205 and between AR system 200 and controller 225. The information may be in the form of optical data, electrical data, wireless data, or any other transmittable data form. Moving the processing of information generated by AR system 200 to neckband 205 may reduce weight and heat in eyewear device 202, making it more comfortable to the user.

Power source 235 in neckband 205 may provide power to eyewear device 202 and/or to neckband 205. Power source 235 may include, without limitation, lithium ion batteries, lithium-polymer batteries, primary lithium batteries, alkaline batteries, or any other form of power storage. In some cases, power source 235 may be a wired power source. Including power source 235 on neckband 205 instead of on eyewear device 202 may help better distribute the weight and heat generated by power source 235.

As noted, some artificial reality systems may, instead of blending an artificial reality with actual reality, substantially replace one or more of a user's sensory perceptions of the real world with a virtual experience. One example of this type of system is a head-worn display system, such as VR system 300 in FIG. 3, that mostly or completely covers a user's field of view. VR system 300 may include a front rigid body 302 and a band 304 shaped to fit around a user's head. VR system 300 may also include output audio transducers 306(A) and 306(B). Furthermore, while not shown in FIG. 3, front rigid body 302 may include one or more electronic elements, including one or more electronic displays, one or more inertial measurement units (IMUs), one or more tracking emitters or detectors, and/or any other suitable device or system for creating an artificial reality experience.

Artificial reality systems may include a variety of types of visual feedback mechanisms. For example, display devices in AR system 200 and/or VR system 300 may include one or more liquid crystal displays (LCDs), light emitting diode (LED) displays, organic LED (OLED) displays, and/or any other suitable type of display screen. Artificial reality systems may include a single display screen for both eyes or may provide a display screen for each eye, which may allow for additional flexibility for varifocal adjustments or for correcting a user's refractive error. Some artificial reality systems may also include optical subsystems having one or more lenses (e.g., conventional concave or convex lenses, Fresnel lenses, adjustable liquid lenses, etc.) through which a user may view a display screen.

In addition to or instead of using display screens, some artificial reality systems may include one or more projection systems. For example, display devices in AR system 200 and/or VR system 300 may include micro-LED projectors that project light (using, e.g., a waveguide) into display devices, such as clear combiner lenses that allow ambient light to pass through. The display devices may refract the projected light toward a user's pupil and may enable a user to simultaneously view both artificial reality content and the real world. Artificial reality systems may also be configured with any other suitable type or form of image projection system.

Artificial reality systems may also include various types of computer vision components and subsystems. For example, AR system 100, AR system 200, and/or VR system 300 may include one or more optical sensors such as two-dimensional (2D) or three-dimensional (3D) cameras, time-of-flight depth sensors, single-beam or sweeping laser rangefinders, 3D LiDAR sensors, and/or any other suitable type or form of optical sensor. An artificial reality system may process data from one or more of these sensors to identify a location of a user, to map the real world, to provide a user with context about real-world surroundings, and/or to perform a variety of other functions.

Artificial reality systems may also include one or more input and/or output audio transducers. In the examples shown in FIGS. 1 and 3, output audio transducers 108(A), 108(B), 306(A), and 306(B) may include voice coil speakers, ribbon speakers, electrostatic speakers, piezoelectric speakers, bone conduction transducers, cartilage conduction transducers, and/or any other suitable type or form of audio transducer. Similarly, input audio transducers 110 may include condenser microphones, dynamic microphones, ribbon microphones, and/or any other type or form of input transducer. In some embodiments, a single transducer may be used for both audio input and audio output.

Figure 3:
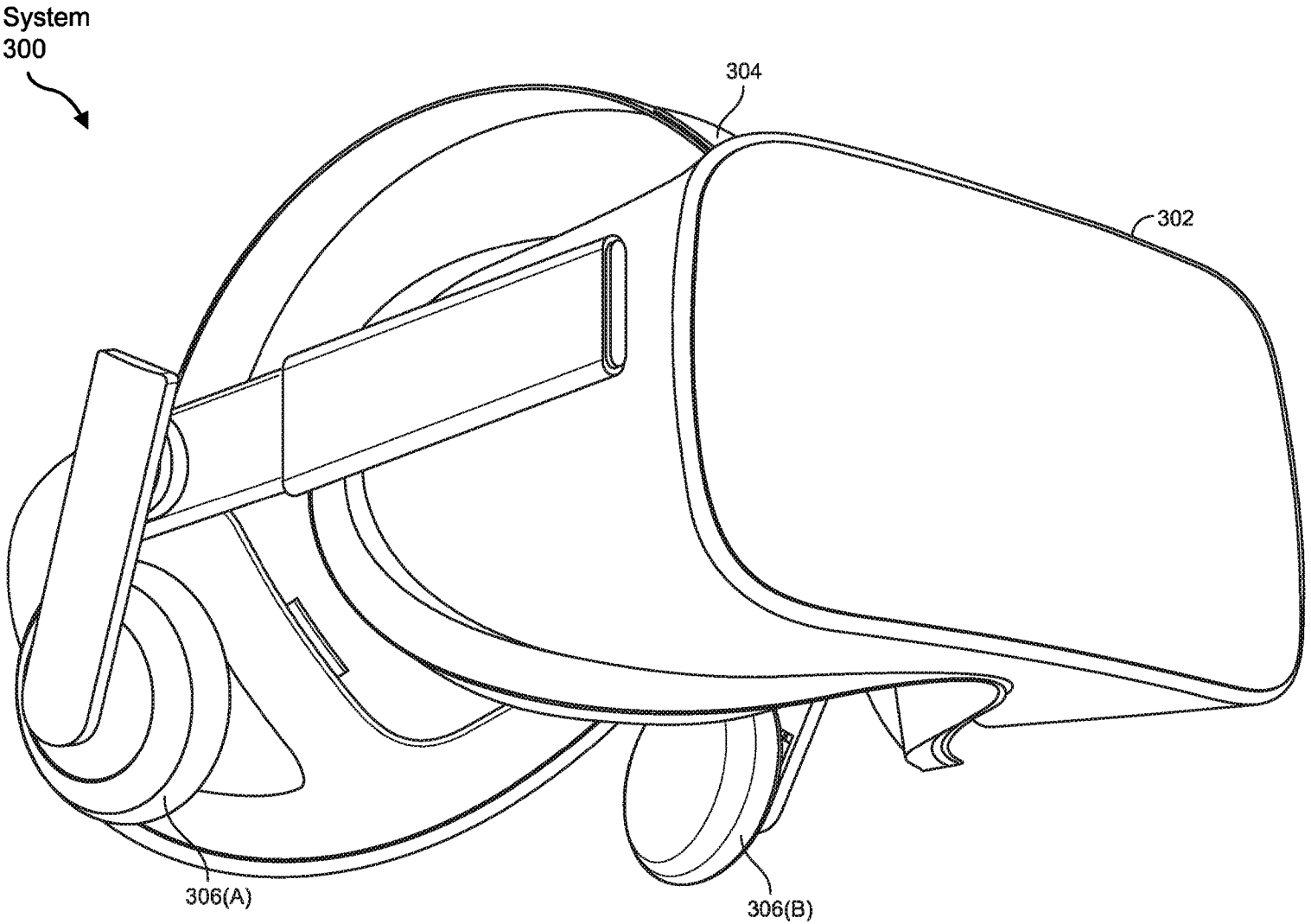
FIG. 3 illustrates an embodiment of a virtual reality headset.

While not shown in FIGS. 1-3, artificial reality systems may include tactile (i.e., haptic) feedback systems, which may be incorporated into headwear, gloves, body suits, handheld controllers, environmental devices (e.g., chairs, floormats, etc.), and/or any other type of device or system. Haptic feedback systems may provide various types of cutaneous feedback, including vibration, force, traction, texture, and/or temperature. Haptic feedback systems may also provide various types of kinesthetic feedback, such as motion and compliance. Haptic feedback may be implemented using motors, piezoelectric actuators, fluidic systems, and/or a variety of other types of feedback mechanisms. Haptic feedback systems may be implemented independent of other artificial reality devices, within other artificial reality devices, and/or in conjunction with other artificial reality devices.

By providing haptic sensations, audible content, and/or visual content, artificial reality systems may create an entire virtual experience or enhance a user's real-world experience in a variety of contexts and environments. For instance, artificial reality systems may assist or extend a user's perception, memory, or cognition within a particular environment. Some systems may enhance a user's interactions with other people in the real world or may enable more immersive interactions with other people in a virtual world. Artificial reality systems may also be used for educational purposes (e.g., for teaching or training in schools, hospitals, government organizations, military organizations, business enterprises, etc.), entertainment purposes (e.g., for playing video games, listening to music, watching video content, etc.), and/or for accessibility purposes (e.g., as hearing aids, visuals aids, etc.). The embodiments disclosed herein may enable or enhance a user's artificial reality experience in one or more of these contexts and environments and/or in other contexts and environments.

Some AR systems may map a user's environment using techniques referred to as "simultaneous location and mapping" (SLAM). SLAM mapping and location identifying techniques may involve a variety of hardware and software tools that can create or update a map of an environment while simultaneously keeping track of a user's location within the mapped environment. SLAM may use many different types of sensors to create a map and determine a user's position within the map.

SLAM techniques may, for example, implement optical sensors to determine a user's location. Radios including WiFi, Bluetooth, global positioning system (GPS), cellular or other communication devices may be also used to determine a user's location relative to a radio transceiver or group of transceivers (e.g., a WiFi router or group of GPS satellites). Acoustic sensors such as microphone arrays or 2D or 3D sonar sensors may also be used to determine a user's location within an environment. AR and VR devices (such as systems 100, 200, or 300 of FIG. 1, 2 or 3, respectively) may incorporate any or all of these types of sensors to perform SLAM operations such as creating and continually updating maps of the user's current environment. In at least some of the embodiments described herein, SLAM data generated by these sensors may be referred to as "environmental data" and may indicate a user's current environment. This data may be stored in a local or remote data store (e.g., a cloud data store) and may be provided to a user's AR/VR device on demand.

When the user is wearing an AR headset or VR headset in a given environment, the user may be interacting with other users or other electronic devices that serve as audio sources. In some cases, it may be desirable to determine where the audio sources are located relative to the user and then present the audio sources to the user as if they were coming from the location of the audio source. The process of determining where the audio sources are located relative to the user may be referred to herein as "localization," and the process of rendering playback of the audio source signal to appear as if it is coming from a specific direction may be referred to herein as "spatialization."

Localizing an audio source may be performed in a variety of different ways. In some cases, an AR or VR headset may initiate a direction of arrival (DOA) analysis to determine the location of a sound source. The DOA analysis may include analyzing the intensity, spectra, and/or arrival time of each sound at the AR/VR device to determine the direction from which the sounds originated. In some cases, the DOA analysis may include any suitable algorithm for analyzing the surrounding acoustic environment in which the artificial reality device is located.

For example, the DOA analysis may be designed to receive input signals from a microphone and apply digital signal processing algorithms to the input signals to estimate the direction of arrival. These algorithms may include, for example, delay and sum algorithms where the input signal is sampled, and the resulting weighted and delayed versions of the sampled signal are averaged together to determine a direction of arrival. A least mean squared (LMS) algorithm may also be implemented to create an adaptive filter. This adaptive filter may then be used to identify differences in signal intensity, for example, or differences in time of arrival. These differences may then be used to estimate the direction of arrival. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct-path audio signal. Those bins having a portion of the direct-path signal may then be analyzed to identify the angle at which a microphone array received the direct-path audio signal. The determined angle may then be used to identify the direction of arrival for the received input signal. Other algorithms not listed above may also be used alone or in combination with the above algorithms to determine DOA.

In some embodiments, different users may perceive the source of a sound as coming from slightly different locations. This may be the result of each user having a unique head-related transfer function (HRTF), which may be dictated by a user's anatomy including ear canal length and the positioning of the ear drum. The artificial reality device may provide an alignment and orientation guide, which the user may follow to customize the sound signal presented to the user based on their unique HRTF. In some embodiments, an artificial reality device may implement one or more microphones to listen to sounds within the user's environment. The AR or VR headset may use a variety of different array transfer functions (e.g., any of the DOA algorithms identified above) to estimate the direction of arrival for the sounds. Once the direction of arrival has been determined, the artificial reality device may play back sounds to the user according to the user's unique HRTF. Accordingly, the DOA estimation generated using the array transfer function (ATF) may be used to determine the direction from which the sounds are to be played from. The playback sounds may be further refined based on how that specific user hears sounds according to the HRTF.

In addition to or as an alternative to performing a DOA estimation, an artificial reality device may perform localization based on information received from other types of sensors. These sensors may include cameras, IR sensors, heat sensors, motion sensors, GPS receivers, or in some cases, sensor that detect a user's eye movements. For example, as noted above, an artificial reality device may include an eye tracker or gaze detector that determines where the user is looking. Often, the user's eyes will look at the source of the sound, if only briefly. Such clues provided by the user's eyes may further aid in determining the location of a sound source. Other sensors such as cameras, heat sensors, and IR sensors may also indicate the location of a user, the location of an electronic device, or the location of another sound source. Any or all of the above methods may be used individually or in combination to determine the location of a sound source and may further be used to update the location of a sound source over time.

Some embodiments may implement the determined DOA to generate a more customized output audio signal for the user. For instance, an "acoustic transfer function" may characterize or define how a sound is received from a given location. More specifically, an acoustic transfer function may define the relationship between parameters of a sound at its source location and the parameters by which the sound signal is detected (e.g., detected by a microphone array or detected by a user's ear). An artificial reality device may include one or more acoustic sensors that detect sounds within range of the device. A controller of the artificial reality device may estimate a DOA for the detected sounds (using, e.g., any of the methods identified above) and, based on the parameters of the detected sounds, may generate an acoustic transfer function that is specific to the location of the device. This customized acoustic transfer function may thus be used to generate a spatialized output audio signal where the sound is perceived as coming from a specific location.

Indeed, once the location of the sound source or sources is known, the artificial reality device may re-render (i.e., spatialize) the sound signals to sound as if coming from the direction of that sound source. The artificial reality device may apply filters or other digital signal processing that alter the intensity, spectra, or arrival time of the sound signal. The digital signal processing may be applied in such a way that the sound signal is perceived as originating from the determined location. The artificial reality device may amplify or subdue certain frequencies or change the time that the signal arrives at each ear. In some cases, the artificial reality device may create an acoustic transfer function that is specific to the location of the device and the detected direction of arrival of the sound signal. In some embodiments, the artificial reality device may re-render the source signal in a stereo device or multi-speaker device (e.g., a surround sound device). In such cases, separate and distinct audio signals may be sent to each speaker. Each of these audio signals may be altered according to the user's HRTF and according to measurements of the user's location and the location of the sound source to sound as if they are coming from the determined location of the sound source. Accordingly, in this manner, the artificial reality device (or speakers associated with the device) may re-render an audio signal to sound as if originating from a specific location.

Figure 4:
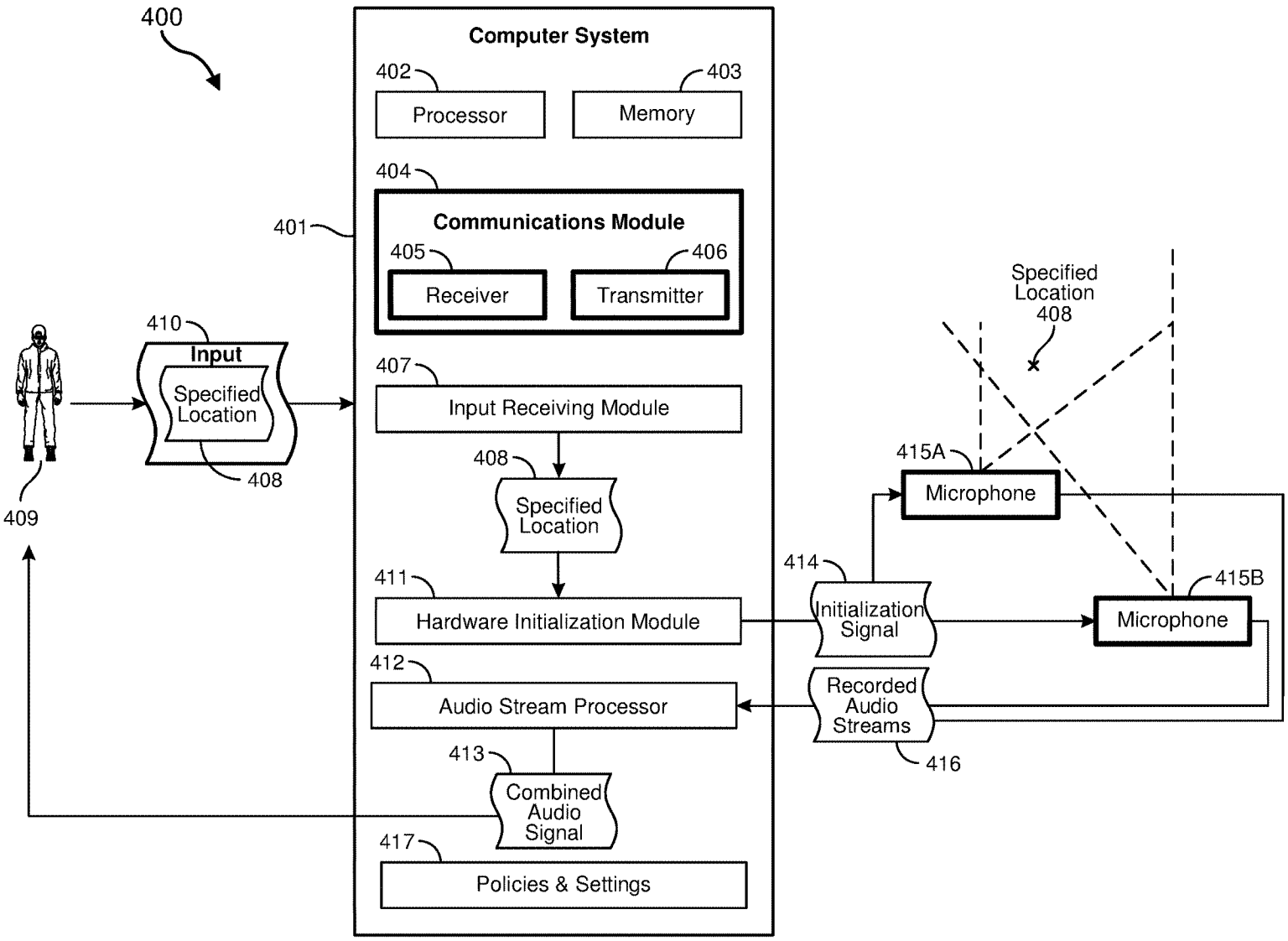
FIG. 4 illustrates an embodiment of a computing architecture in which the embodiments herein may operate.

The following will provide, with reference to FIGS. 4-10, detailed descriptions of how a virtual microphone is initialized and operated. FIG. 4, for example, illustrates a computing architecture 400 in which many of the embodiments described herein may operate. The computing architecture 400 may include a computer system 401. The computer system 401 may include at least one processor 402 and at least some system memory 403. The computer system 401 may be any type of local or distributed computer system, including a cloud computer system. The computer system 401 may include program modules for performing a variety of different functions. The program modules may be hardware-based, software-based or may include a combination of hardware and software. Each program module may use or represent computing hardware and/or software to perform specified functions, including those described herein below.

For example, communications module 404 may be configured to communicate with other computer systems. The communications module 404 may include any wired or wireless communication means that can receive and/or transmit data to or from other computer systems. These communication means may include radios including, for example, a hardware-based receiver 405, a hardware-based transmitter 406, or a combined hardware-based transceiver capable of both receiving and transmitting data. The radios may be WIFI radios, cellular radios, Bluetooth radios, global positioning system (GPS) radios, or other types of radios. The communications module 404 may be configured to interact with databases, mobile computing devices (such as mobile phones or tablets), embedded systems, or other types of computing systems.

Computer system 401 may also include an input receiving module 407. The input receiving module 407 may be configured to receive input 410 from a user such as user 409. The input 410 may be received from a smartphone, artificial reality device or other electronic device. The input 410 may specify a location 408 where a virtual microphone is to be established. The location may be a general location (such a specific room) or may be a specific coordinate-based location that lists, for example, global positioning system (GPS) coordinates for the location 408. The specified location may be passed to the hardware initialization module 411 of computer system 401. The hardware initialization module 411 may initialize microphones 415A and 415B and may physically or digitally direct or orient the microphones to the specified location 408. The process of directing the microphones to a specific location may be referred to as "beamforming" herein. The beams of the microphones 415A and 415B may, for example, be oriented toward the specified location 408, as shown in FIG. 1. Other microphones may also be used to record from the specified location 408, as will be explained further below.

Once the microphones begin recording audio signals, each microphone may send its respective audio stream 416 to the audio stream processor 412 of computer system 401. This audio stream processor 412 may be the same as or different than processor 402. In some cases, the audio stream processor 412 and the processor 402 may share the load of processing the recorded audio streams 416. In other cases, the audio stream processor 412 may be located in a remote location, such as in a cloud server. As such, some or all of the audio processing may be performed remotely from the computer system 401.

The audio stream processor 412 may apply digital signal processing to the various recorded audio streams 416 and may combine the signals into a single audio signal 413. This combined signal 413 may be processed to take the sounds received from one microphone and combine them with the sounds received by the other microphone(s). Each recorded audio stream may be analyzed and processed to focus on sounds coming from the specified location 408. This combined audio signal 413 may then be sent to a user 409, or another electronic device or computing system. The combined audio signal 413 may thus represent sounds that would be heard from the specified location 408 of the virtual microphone. These embodiments will be described in greater detail below with regard to method 500 of FIG. 5.

Figure 5:
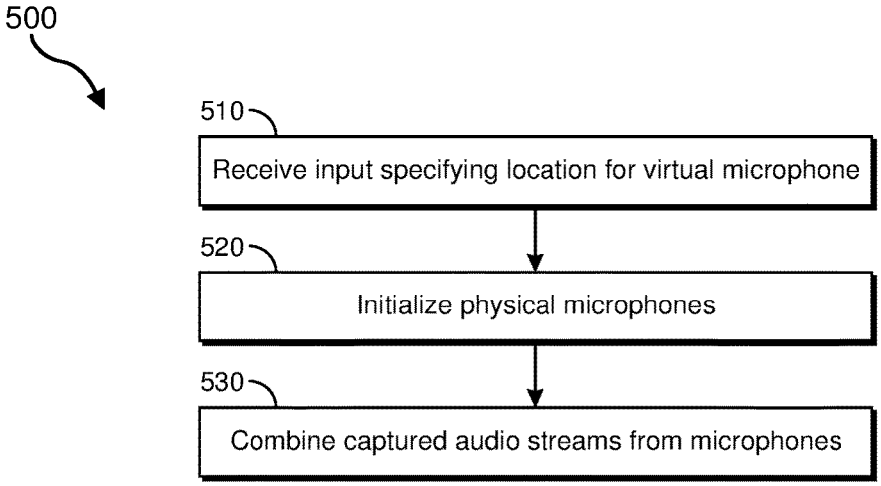
FIG. 5 illustrates a flow diagram of an exemplary method for initializing and operating a virtual microphone.

FIG. 5 is a flow diagram of an exemplary computer-implemented method 500 for initializing and operating a virtual microphone. The steps shown in FIG. 5 may be performed by any suitable computer-executable code and/or computing system, including the system(s) illustrated in FIG. 4. In one example, each of the steps shown in FIG. 5 may represent an algorithm whose structure includes and/or is represented by multiple sub-steps, examples of which will be provided in greater detail below.

As illustrated in FIG. 5, at step 510, one or more of the systems described herein may initialize and operate a virtual microphone. Step 510 may include receiving an input 410 specifying a location 408 for a virtual microphone that is configured to capture audio as if located in the specified location. The location may be indicated in a variety of different ways. For example, the user 409 may specify a location by supplying GPS coordinates, by selecting a location on a map on a smartphone, by selecting a location from a drop-down list of available locations, by physically pointing in a given direction and having that location tracked by an artificial reality headset (e.g., 100, 200 or 300 of FIG. 1, 2 or 3, respectively), by audibly describing the location, or via some other input mechanism. The specified location 408 may be exact (i.e., an exact spot on a wall in a room) or may be general (i.e. in room 550 in Building A, or in the user's backyard). In such embodiments, the virtual microphone may be established at the exact spot, or at a location somewhere near the spot.

Once the location 408 has been specified, the hardware initialization module 411 may initialize two or more physical microphones (e.g., 415A and 415B) to begin capturing audio as if located at the specified location 408 (at step 520). The microphones may be electronically or physically oriented to listen from the specified location 408. Physically orienting the microphones may include mechanically turning one or more physical elements of the microphone toward the physical location 408. Servos, solenoids or other actuators may cause the movement of the microphones physical elements. Additionally or alternatively, the microphones may be electronically or digitally steered toward the specified location 408. This beamforming process may direct the microphones to listen specifically to noises or sounds coming from the specified location 408. Direction of arrival calculations, frequency analyses, spectra analyses or other digital signal processing may be used to calculate and refine the beamforming and to direct the microphones specifically toward the specified location 408.

In cases where the microphones are part of or embedded in mobile devices (e.g., part of smartphones, tablets, artificial reality devices, etc.), the microphones may be moving along with the user. As such, these direction of arrival and similar calculations may be continually reperformed to update the direction of the beamforming. As such, even if the microphones move relative to the specified location 408, the continual updates ensure that the microphones are physically or electronically directed to the specified location 408.

Although only two microphones are shown in FIG. 4, it will be understood that any given virtual microphone may include substantially any number of physical microphones contributing to the combined signal. Each of the physical microphones may be added or removed from the virtual microphone in an ad hoc manner. Each physical microphone may provide a recorded audio stream 416 that is fed to an audio stream processor. The audio stream processor 412 may combine audio streams from physical microphones to generate a combined audio signal 413 that sounds as if recorded at the specified location 408 (at step 530). Each physical microphone may be located in a different spot relative to the specified location 408 and, as such, may record sounds from the specified location 408 in a slightly different manner. For example, some users may be near walls or other objects that cause reflections; or, the user may be standing behind a table or couch or behind another person. Any of these objects or people may cause sounds to propagate in a slightly different manner within the environment. The audio stream processor 412 may account for these differences when combining the recorded audio streams. As such, the audio stream processor may modify each recorded audio stream 416 to sound as if coming from the same specified location 408, regardless of differences in recordings. The resulting combined audio signal 413 may thus be a clear and distinct signal, even though it may include a combination of many different microphone feeds.

Figure 6:
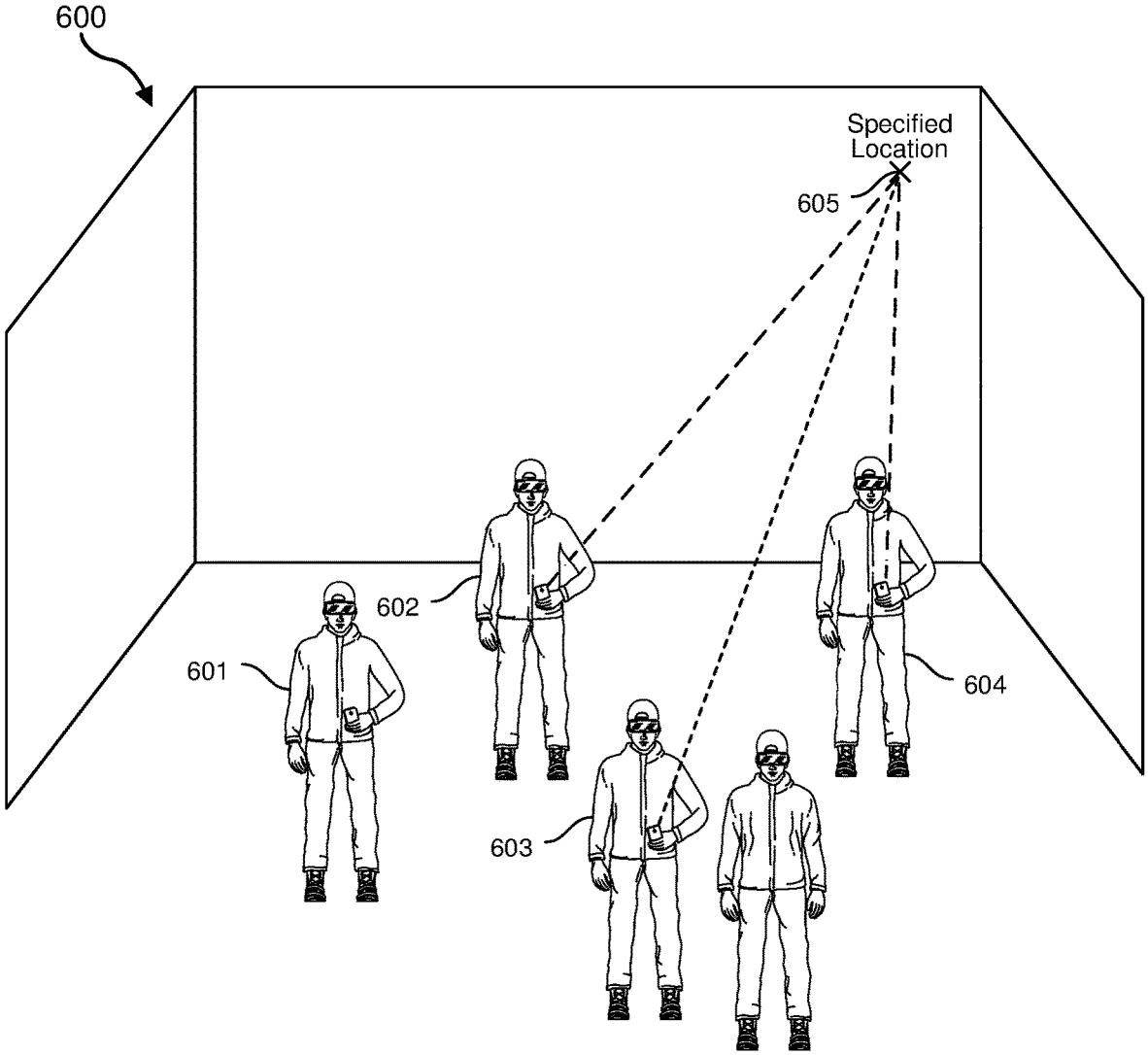
FIG. 6 illustrates an embodiment in which multiple electronic devices are used to create a virtual microphone.

As noted above, a virtual microphone may be initialized and operated in substantially any environment. In some case, the selected environment may be mapped using any of the SLAM techniques described above. SLAM data or simply "environment data" may be used to identify certain acoustic characteristics of the environment. The computer system 101 may use these acoustic characteristics to refine the combined audio signal 413. For instance, as illustrated in FIG. 6, the environment 600 in which a virtual microphone may be established may include walls, people, a floor, a ceiling, and potentially furniture such as a couch or chairs (not shown). The people (e.g., users 601-604) may be wearing artificial reality devices including augmented reality devices or virtual reality devices. The people may also have smartphones or other mobile devices. Each of these mobile devices may be capable of communicating with other computer systems (or with other artificial reality devices) via computer networks such as WiFi, Bluetooth, or cellular networks. As such, each of these devices may be configured to access environment data related to the current environment 600. The environment data may include previously stored data, as well as updated mapping data received from the other artificial reality devices or mobile devices.

In some embodiments, the computer system 401 of FIG. 4 may receive information relative to environment 600 of FIG. 6. The computer system 401 may determine that a user has specified a location for a virtual microphone (e.g., location 605), and may further determine that the specified location 605 is within the environment 600. The computer system 401 may then implement the received environment information to customize one or more acoustic characteristics of the specified location. Thus, for example, because user 604 is standing close to a wall, the acoustic characteristics of the audio recorded by that user's associated microphones may be slightly different than those for user 602 or user 603. The audio stream processor 412 may account for these differences when combining the audio streams. In the embodiment of FIG. 6, user 601 is shown as being too far away from the specified location 605 to record audio from that location. As will be shown in FIG. 6, if the user 601 moves closer to the specified location 605, then the user's devices may be used to record audio as part of a virtual microphone.

The environment data may indicate not only the acoustic characteristics of a given location but may also indicate that one or more people are within a given distance of the specified location. Thus, the user's artificial reality devices and/or phones may indicate their location within the environment. This information may be used to determine where people are in the environment and, more specifically, how close the people are to the specified location 605. For instance, the environment data may indicate that users 602, 603 and 604 are close enough to the specified location 605 to be heard by the virtual microphone, while user 601 is close to the location 605 but not close enough to contribute to the virtual microphone. In some embodiments, the virtual microphone may be activated or deactivated automatically upon determining that one or more people are within audible distance of the virtual microphone. Policies and settings 417 may govern if and when the virtual microphone may be activated. Still further, in some cases, the environment data may indicate that specific, identified persons are within a given distance of the location 605. Again, policies and settings 417 may indicate that the virtual microphone is to be activated or deactivated in the presence these known persons.

In some cases, the audio stream processor 412 of FIG. 4 may determine that people or specific persons are within range of a specified location even without receiving environment information from a server or from the user's mobile phones or artificial reality devices. For instance, the audio stream processor 412 may be configured to analyze audio streams from any physical microphones that have been activated, including potentially stationary microphones that are installed within the environment. The audio stream processor may analyze audio from the activated microphones to detect whether the sounds are spoken words coming from users, or whether the sounds are from another sound source (e.g., an electronic device). In some cases, the audio stream processor 412 may analyze voice patterns, frequencies, tones or other acoustic characteristics to identify specific persons that are within audible range of the specified location. Again, policies and settings 417 may dictate when such analysis and positive identification steps may be taken.

At least in some embodiments, these policies and settings 417 may be far reaching and may place potentially strict limitations on when and where and at what times a virtual microphone may be established and operated. For instance, geography-based policies may indicate locations where a virtual microphone is permissible or impermissible. Time-based policies may indicate dates and/or times when a virtual microphone is permissible or impermissible. Individual-based policies may indicate that virtual microphones can or cannot be used when a certain individual is near the specified location. These policies may be used alone or in combination with each other.

In one example, a virtual microphone may have a time-based policy indicating that it can be used between 7 pm-10 pm on Fridays and Saturdays and cannot be used even during those times if a certain individual or set of individuals is present. Another virtual microphone may have a policy indicating which rooms of a building allow virtual microphones and which times of day the virtual microphones can be used in the rooms that allow such use. These policies may be set and managed by individual users, by property owners or managers, by government entities, by business entities or by other persons. In some cases, mobile electronic devices such as phones or artificial reality devices may, by default, prohibit the device from participating in a virtual microphone unless the user specifically opts in to allow such use.

However, even if a user opts in to allow their device to participate in ad hoc virtual microphones, the user's opt in may still be subject to policies indicating times and locations where their mobile device is or is not usable as a virtual microphone. In some embodiments, a user-initiated placement of the virtual microphone may be overridden by a location-based policy indicating that virtual microphones are disallowed at the specified location. As such, any initialized microphones may be disengaged or prevented in the first place. Accordingly, default options may prevent using certain mobile devices as virtual microphones and, even when engaged or opted into by a user, other location-based, time-based or individual-based policies may override a user's request to establish a virtual microphone.

Figure 7:
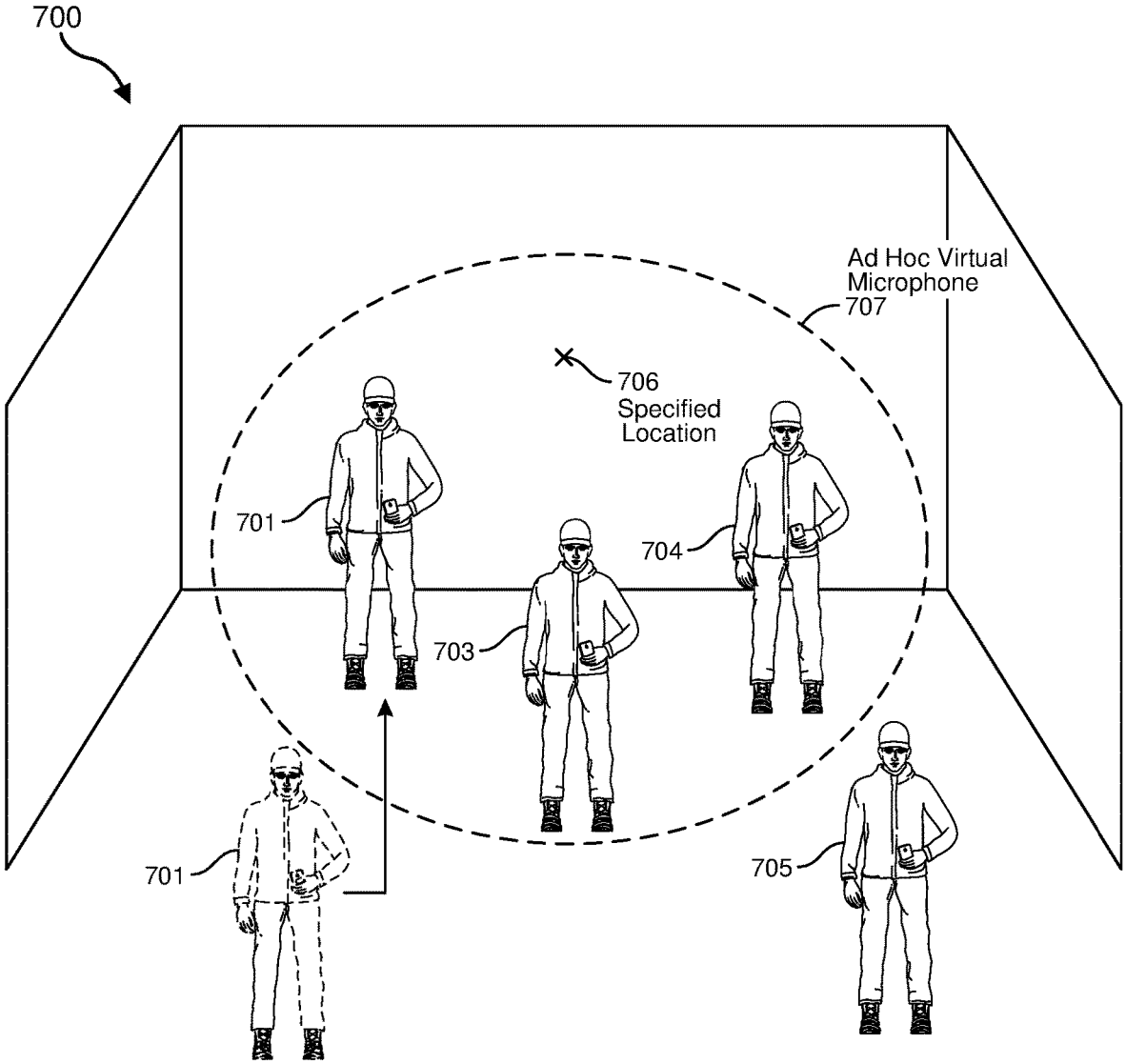
FIG. 7 illustrates an alternative embodiment in which multiple electronic devices are used to create a virtual microphone.

In some embodiments, a virtual microphone may be activated upon detecting audible sounds within range of the virtual microphone. For example, as shown in FIG. 7, an ad hoc virtual microphone 707 may be activated upon detecting audible sounds from any of the users 701-705 (assuming policies permit such activation). In some cases, substantially any detected sounds may activate the virtual microphone. In other cases, the sounds may be analyzed to determine who or what caused the sounds. Then, if the sounds were determined to come from something or someone sufficiently important to initiate the virtual microphone, the virtual microphone (e.g., 707) will be established. Still further, in some cases, policies 417 may indicate that the sound needs to be above a minimum threshold dB level to activate the virtual microphone.

Once the virtual microphone 707 has been established, one or more mobile devices having microphones that come within a specified distance of the specified location 706 may be initialized to capture audio and provide the captured audio to the combined audio stream. For instance, when the virtual microphone 707 is established (e.g., by computer system 401 of FIG. 4), the computer system 401 may communicate to other artificial reality devices or smart phones or other mobile devices in the area (e.g., via direct connections or via connections to a common server or group of distributed servers) indicated by the dotted-line circle. This area may be bigger or smaller in any given implementation, depending on policies and perhaps depending on the environment. In the embodiment of FIG. 7, any mobile electronic devices within the dotted-line circle may be added to the ad hoc virtual microphone. The area of the virtual microphone may be a fixed area of specified distance, or may be an unspecified, amorphous area where any devices that are in communication range are included.

Initially, users 703 and 704 and their corresponding electronic devices may be within range of the specified location 706 and may be initialized as part of the ad hoc virtual microphone 707. User 701, however, may initially be outside of the range of the virtual microphone 707. As user 701 moves from outside the dotted-line circle to inside the circle, user 701's mobile electronic device may be automatically added to the ad hoc virtual microphone. As users come and go from the dotted-line circle surrounding the specified location 706, their devices may be added to or dropped from the ad hoc virtual microphone 707. When devices are part of the virtual microphone 707, they may transmit their recorded audio to other local mobile devices and/or may transmit their recorded audio to a local or remote server. Furthermore, the electronic devices that are part of the ad hoc virtual microphone 707 may store the recorded audio locally and/or on a remote data store such as a cloud data store. A location for a virtual microphone may be selected by a user even if no users are currently near the location. Then, as users move into range of the virtual microphone 707, the microphones on their mobile devices may automatically be added to the virtual microphone, capturing audio data as long as they are within range. That data may be transmitted to a server and/or stored. Then, once the users move out of range, they may be dropped from the virtual microphone 707.

Figure 8:
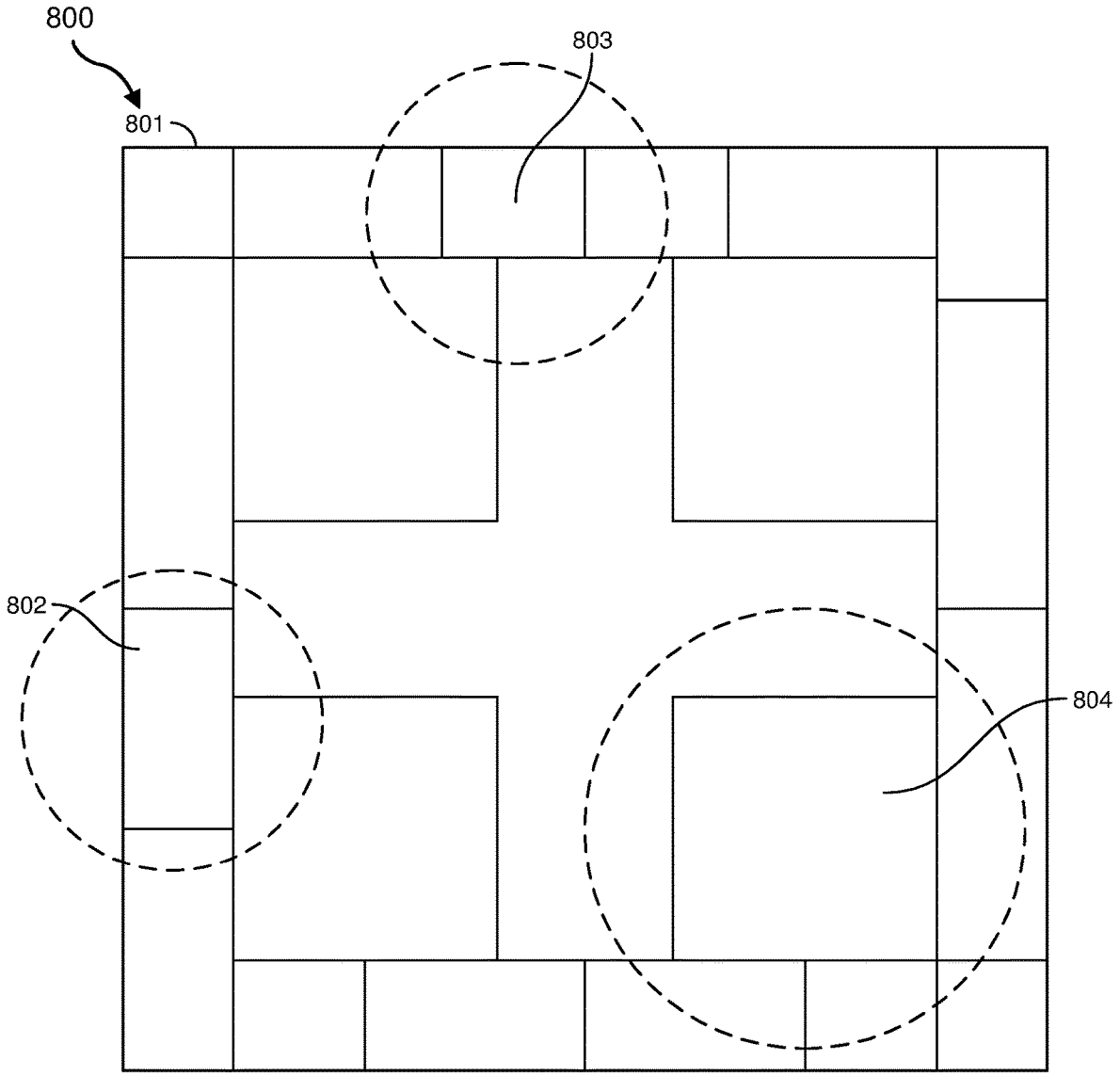
FIG. 8 illustrates an embodiment in which virtual microphones are allowed or disallowed.

FIG. 8 illustrates an embodiment in which certain parts of an environment are deemed permissible to establish a virtual microphone, while other areas are not. For example, in environment 800, areas 802, 803 and 804 may represent areas where virtual microphones are allowed to be established and operated subject to policies. The environment 800, for example, may be an office building 801 that has many different rooms or offices. A building manager or tenant may specify which offices allow virtual microphones to be established. The building manger or tenant may specify, for example, that on a certain floor, offices 802 and 803 may allow virtual microphones, as well as room 804. Other offices and areas may, by default, prohibit the use of virtual microphones. Thus, in such areas, if a user attempted to initialize a virtual microphone, software policies may prohibit the virtual microphone from being established. In areas where virtual microphones are allowed (e.g., 803), the user may specify an office or room as the location to establish the virtual microphone or may specify a certain spot within the office or room. Once activated, the virtual microphone may begin to operate as described above. In some cases, the virtual microphone may be configured to take observations about the specified location. Such observations may include notations of when sounds are made, who made the sounds, what type of sounds were made, etc. These observations may be stored in a data store and/or may be used to modify policies related to the virtual microphone.

Figure 9:
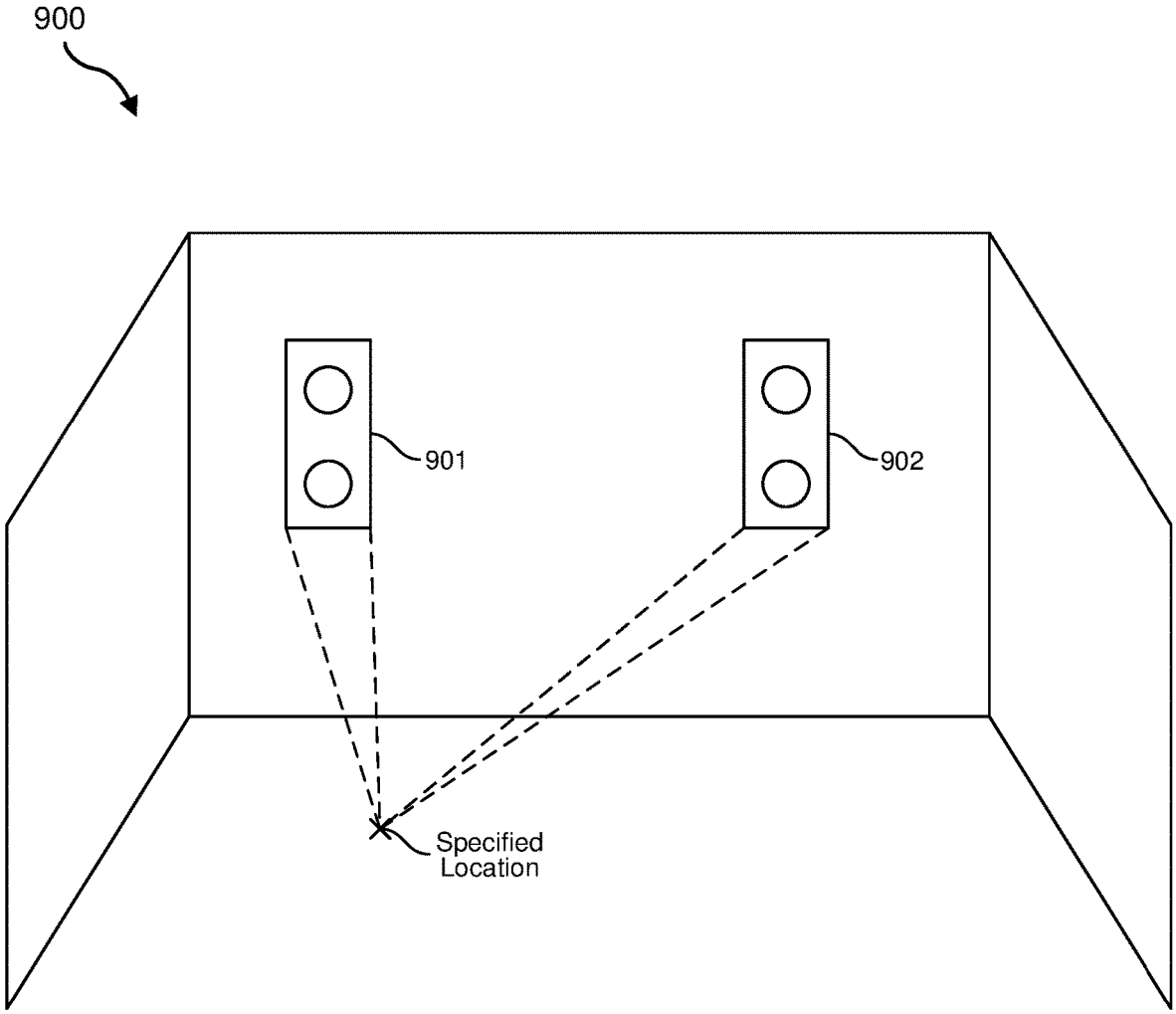
FIG. 9 illustrates an embodiment in which speakers are directed to a specification to sound as if originating from that location.

While many of the embodiments herein have been described with reference to microphones and virtual microphones, it will be understood that speakers and virtual speakers may also be directed to a specific location. FIG. 9, for example, illustrates an embodiment 900 in which speakers 901 and 902 are directed to a specified location in a room. These speakers may be configured to beamform their projected sounds to a specified location to sound as if coming from that location. Thus, in one embodiment, the physical speakers 901 and 902 may be physically or electronically oriented to project sound as if coming from the specified location, thereby creating a virtual speaker at the specified location. Alternatively, the speakers 901 and 902 may be earbuds or earphones surrounding a user's ears. The speakers in these earbuds or earphones may be electronically or physically oriented to make the projected audio sound as if coming from the specified location. Thus, within a virtual world or in an environment that is being augmented with computer-generated images, users may pin virtual speakers to a specified location (e.g., on a ceiling in a hallway). Then, when other users walk by, they may hear sounds in their earbuds or earphones as if coming from the specified location.

Figure 10:
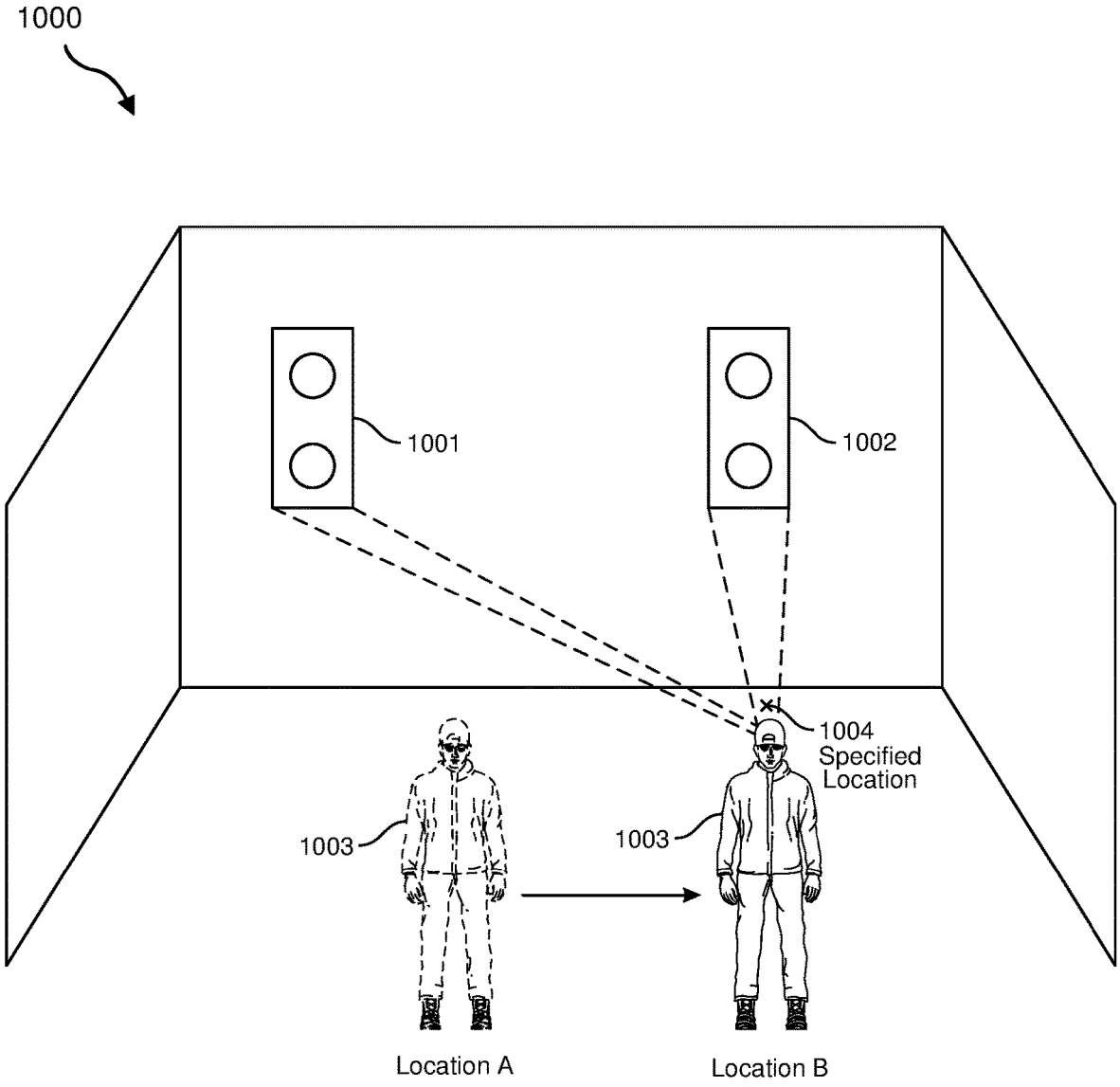
FIG. 10 illustrates an embodiment in which a sequence of actions takes place when a user is detected in a specified location.

The pinned virtual speakers may stay pinned to the specified location for a specified amount of time or may stay indefinitely pinned to that location. Within the virtual or augmented world, these virtual speakers may perform certain actions when a user's presence is detected. For example, as shown in FIG. 10, when user 1003 walks by a specified location 1004 (e.g., moving from location A to location B), the virtual speakers 1001 and 1002 may be programmed to play a greeting or provide the time or play a song. User 1003's presence may be detected using any of the sensors described above including cameras, motion detectors, IR sensors, GPS locators or similar devices. Such virtual speakers may be pinned within a user's home to play audio reminders or to play music when the user is in a certain room. The physical speakers in the area will be recruited (as with the microphones) to play sounds as if coming from the virtual speakers. The virtual speakers may also be configured to take an action or series of actions based on policies. The policies may dictate when, how and what is played by the virtual speakers. Different actions may be taken in different locations, or at different times, or when different individuals are present. Accordingly, the virtual speakers may be controlled by users or property owners using policies. These policies may allow or prohibit the use of virtual speakers or may limit their use to certain times and locations.

In addition to the methods described above for establishing a virtual microphone or speaker, a corresponding system for establishing and implementing a virtual microphone may include several modules stored in memory, including an input receiving module configured to receive an input specifying a location for a virtual microphone that is configured to capture audio as if located in the specified location. The system may also include a hardware initialization module configured to initialize physical microphones to begin capturing audio as if located at the specified location. The physical microphones may be electronically or physically oriented to listen from the specified location. The system may also include an audio stream processor configured to combine audio streams from the physical microphones to generate a combined audio signal that sounds as if recorded at the specified location.

In some examples, the above-described method may be encoded as computer-readable instructions on a computer-readable medium. For example, a computer-readable medium may include one or more computer-executable instructions that, when executed by at least one processor of a computing device, may cause the computing device to receive an input specifying a location for a virtual microphone that is configured to capture audio as if located in the specified location, and initialize physical microphones to begin capturing audio as if located at the specified location. The physical microphones may be electronically or physically oriented to listen from the specified location. The computing device may also combine audio streams from the physical microphones to generate a combined audio signal that sounds as if recorded at the specified location.

Accordingly, users may implement the methods and systems described herein to establish virtual microphones in specified locations. These virtual microphones may capture audio from many different physical microphones and blend the signals together to create a single unified signal that sounds as if coming from the specified location. These virtual microphones may be governed by policies that limit when, where, and how the virtual microphones may be used. Virtual speakers may also be established to project sound as if coming from a specified location.

As detailed above, the computing devices and systems described and/or illustrated herein broadly represent any type or form of computing device or system capable of executing computer-readable instructions, such as those contained within the modules described herein. In their most basic configuration, these computing device(s) may each include at least one memory device and at least one physical processor.

In some examples, the term "memory device" generally refers to any type or form of volatile or non-volatile storage device or medium capable of storing data and/or computer-readable instructions. In one example, a memory device may store, load, and/or maintain one or more of the modules described herein. Examples of memory devices include, without limitation, Random Access Memory (RAM), Read Only Memory (ROM), flash memory, Hard Disk Drives (HDDs), Solid-State Drives (SSDs), optical disk drives, caches, variations or combinations of one or more of the same, or any other suitable storage memory.

In some examples, the term "physical processor" generally refers to any type or form of hardware-implemented processing unit capable of interpreting and/or executing computer-readable instructions. In one example, a physical processor may access and/or modify one or more modules stored in the above-described memory device. Examples of physical processors include, without limitation, microprocessors, microcontrollers, Central Processing Units (CPUs), Field-Programmable Gate Arrays (FPGAs) that implement softcore processors, Application-Specific Integrated Circuits (ASICs), portions of one or more of the same, variations or combinations of one or more of the same, or any other suitable physical processor.

Although illustrated as separate elements, the modules described and/or illustrated herein may represent portions of a single module or application. In addition, in certain embodiments one or more of these modules may represent one or more software applications or programs that, when executed by a computing device, may cause the computing device to perform one or more tasks. For example, one or more of the modules described and/or illustrated herein may represent modules stored and configured to run on one or more of the computing devices or systems described and/or illustrated herein. One or more of these modules may also represent all or portions of one or more special-purpose computers configured to perform one or more tasks.

In addition, one or more of the modules described herein may transform data, physical devices, and/or representations of physical devices from one form to another. For example, one or more of the modules recited herein may receive data to be transformed, transform the data, output a result of the transformation to perform a function, use the result of the transformation to perform a function, and store the result of the transformation to perform a function. Additionally or alternatively, one or more of the modules recited herein may transform a processor, volatile memory, non-volatile memory, and/or any other portion of a physical computing device from one form to another by executing on the computing device, storing data on the computing device, and/or otherwise interacting with the computing device.

In some embodiments, the term "computer-readable medium" generally refers to any form of device, carrier, or medium capable of storing or carrying computer-readable instructions. Examples of computer-readable media include, without limitation, transmission-type media, such as carrier waves, and non-transitory-type media, such as magnetic-storage media (e.g., hard disk drives, tape drives, and floppy disks), optical-storage media (e.g., Compact Disks (CDs), Digital Video Disks (DVDs), and BLU-RAY disks), electronic-storage media (e.g., solid-state drives and flash media), and other distribution systems.

Embodiments of the instant disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HMD) connected to a host computer system, a standalone HMD, a mobile device or computing system, or any other hardware platform capable of providing artificial reality content to one or more viewers.

The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and have the same meaning as the word "comprising."

We claim:

1. A computer-implemented method comprising:

receiving an input specifying a location for a virtual microphone that is configured to capture audio as if located in the specified location;

initializing two or more physical microphones to begin capturing audio as if located at the specified location, wherein the two or more physical microphones are electronically or physically oriented to listen from the specified location;

combining audio streams from the two or more physical microphones to generate a combined audio signal that sounds as if recorded at the specified location;

receiving one or more portions of information relative to an environment;

determining that the specified location is within the environment; and implementing the received environment information to customize one or more acoustic characteristics of the specified location.

2. The computer-implemented method of claim 1, wherein the environment information indicates that the specified location is within a building, and further indicates which part of the building the specified location is in.

3. The computer-implemented method of claim 1, wherein the environment information indicates that one or more people are within a given distance of the specified location.

4. The computer-implemented method of claim 1, wherein one or more other mobile devices having microphones that come within a specified distance of the specified location are initialized to capture audio and provide the captured audio to the combined audio stream.

5. The computer-implemented method of claim 1, further comprising analyzing the combined audio streams from the two or more physical microphones to identify specific persons that are within audible range of the specified location.

6. The computer-implemented method of claim 1, wherein the virtual microphone is governed by one or more policies indicating when capturing audio from the virtual microphone is permissible.

7. The computer-implemented method of claim 6, wherein the virtual microphone policies are geography-based, time-based or individual-based.

8. The computer-implemented method of claim 1, wherein the virtual microphone is activated upon detecting audible sounds within range of the virtual microphone.

9. The computer-implemented method of claim 8, further comprising taking one or more observations about the specified location upon activation of the virtual microphone, wherein the observations are stored in a data store.

10. The computer-implemented method of claim 1, wherein the two or more physical microphones are at least initially not located at the specified location.

11. A system comprising:

at least one physical processor;

physical memory comprising computer-executable instructions that, when executed by the physical processor, cause the physical processor to:

receive an input specifying a location for a virtual microphone that is configured to capture audio as if located in the specified location;

initialize two or more physical microphones to begin capturing audio as if located at the specified location, wherein the two or more physical microphones are electronically or physically oriented to listen from the specified location;

combine audio streams from the two or more physical microphones to generate a combined audio signal that sounds as if recorded at the specified location;

receive one or more portions of information relative to an environment;

determine that the specified location is within the environment; and implement the received environment information to customize one or more acoustic characteristics of the specified location.

12. The system of claim 11, wherein at least one of the physical microphones is embedded in a mobile device associated with a user.

13. The system of claim 12, wherein the user opts in to allow their mobile device to be used as a virtual microphone.

14. The system of claim 13, wherein the user's opt in is subject to one or more policies indicating times and locations where their mobile device is usable as a virtual microphone.

15. The system of claim 13, wherein a user-initiated placement of the virtual microphone is overridden by a location-based policy indicating that virtual microphones are disallowed at the specified location, such that the initialized microphones are disengaged.

16. The system of claim 11, further comprising: initializing two or more physical speakers at the specified location, wherein the two or more physical speakers are electronically or physically oriented to project sound as if coming from the specified location.

17. The system of claim 16, further comprising associating a sequence of actions with the specified location, such that when a user is detected in the specified location, the sequence of actions takes place.

18. The system of claim 17, wherein the sequence of actions takes place at a scheduled time.

19. A non-transitory computer-readable medium comprising one or more computer-executable instructions that, when executed by at least one processor of a computing device, cause the computing device to:

receive an input specifying a location for a virtual microphone that is configured to capture audio as if located in the specified location;

initialize two or more physical microphones to begin capturing audio as if located at the specified location, wherein the two or more physical microphones are electronically or physically oriented to listen from the specified location;

combine audio streams from the two or more physical microphones to generate a combined audio signal that sounds as if recorded at the specified location;

receive one or more portions of information relative to an environment;

determine that the specified location is within the environment; and implement the received environment information to customize one or more acoustic characteristics of the specified location.

20. The computer-implemented method of claim 1, wherein the received information relative to the environment comprises simultaneous location and mapping (SLAM) data.

* * * * *